US010854144B2

(12) United States Patent
Pyo et al.

(10) Patent No.: US 10,854,144 B2
(45) Date of Patent: Dec. 1, 2020

(54) DISPLAY DEVICE AND RELATED OPERATING METHOD INVOLVING DIMMING CONTROL

(71) Applicant: Samsung Display Co., Ltd., Yongin-Si (KR)

(72) Inventors: Si-Beak Pyo, Cheonan-si (KR); Choonyul Oh, Seongnam-si (KR); Jong-Kwang Hwang, Asan-si (KR)

(73) Assignee: Samsung Display Co., Ltd.

( * ) Notice: Subject to any disclaimer, the term of this patent is extended or adjusted under 35 U.S.C. 154(b) by 3 days.

(21) Appl. No.: 16/254,450

(22) Filed: Jan. 22, 2019

(65) Prior Publication Data

US 2019/0266952 A1 Aug. 29, 2019

(30) Foreign Application Priority Data

Feb. 23, 2018 (KR) ..... 10-2018-0021731

(51) Int. Cl.
*G09G 3/3291* (2016.01)
*G09G 3/3233* (2016.01)
*G09G 3/3275* (2016.01)

(52) U.S. Cl.
CPC ..... *G09G 3/3291* (2013.01); *G09G 3/3233* (2013.01); *G09G 3/3275* (2013.01); *G09G 2300/0809* (2013.01); *G09G 2310/04* (2013.01); *G09G 2320/0626* (2013.01); *G09G 2330/021* (2013.01)

(58) Field of Classification Search
CPC ..... G09G 3/3233; G09G 3/3208; G09G 2320/0233; G09G 2320/0673; G09G 2320/0626; G09G 2320/0285; G09G 2360/16; G09G 2360/144; G09G 3/3275; G09G 3/3291; G09G 2320/0276; G09G 2320/021
See application file for complete search history.

(56) References Cited

U.S. PATENT DOCUMENTS

| | | | | |
|---|---|---|---|---|
| 8,982,164 | B2 | 3/2015 | Pyo | |
| 9,013,519 | B2 | 4/2015 | Park et al. | |
| 9,460,657 | B2 | 10/2016 | Pyo | |
| 2016/0189676 | A1 | 6/2016 | Pyo | |
| 2016/0314760 | A1* | 10/2016 | Jangda | G09G 3/3208 |
| 2017/0011682 | A1 | 1/2017 | Pyo et al. | |
| 2017/0186375 | A1* | 6/2017 | Jung | G09G 3/3233 |

FOREIGN PATENT DOCUMENTS

KR 10-1679360 B1 11/2016

* cited by examiner

*Primary Examiner* — Xuemei Zheng
(74) *Attorney, Agent, or Firm* — Innovation Counsel LLP

(57) ABSTRACT

A display device includes a display panel, a dimming controller, and a panel driver. The display panel includes a plurality of pixels. The dimming controller generates at least one temporary voltage set by performing a first interpolating operation using a (j)th band voltage set and a (j+1)th band voltage set among first through (i)th band voltage sets corresponding to first through (i)th dimming bands, respectively, and generates a grayscale gamma voltage set corresponding to target luminance by performing a second interpolating operation using the temporary voltage set and the (j)th band voltage set. The panel driver drives the display panel by converting image data into a data signal based on the grayscale gamma voltage set and by providing the data signal to the pixels.

20 Claims, 11 Drawing Sheets

FIG. 3

BD

| BAND# | TARGET LUMINANCE (nits) | DIMMING LEVEL | BAND VOLTAGE SET | PIXEL VOLTAGE OFFSET (V) |
|---|---|---|---|---|
| BANDi | 750 | 2047 | GSETi | 0.0 |
| BAND(i-1) | 650 | 1918 | GSET(i-1) | 0.2 |
| ... | | | | |
| BAND2 | 4 | 190 | GSET2 | 0.6 |
| BAND1 | 2 | 139 | GSET1 | 0.5 |

FIG. 4

ID

| REFERENCE GRAYSCALE | BAND1 | BAND2 | ... | BAND(i-1) |
|---|---|---|---|---|
| 255 | IDX1_255[4:0] | IDX2_255[4:0] | ... | IDX(i-1)_255[4:0] |
| 203 | IDX1_203[4:0] | IDX2_203[4:0] | ... | IDX(i-1)_203[4:0] |
| ... | | | | |
| 7 | IDX1_7[4:0] | IDX2_7[4:0] | ... | IDX(i-1)_7[4:0] |
| 1 | IDX1_1[4:0] | IDX2_1[4:0] | ... | IDX(i-1)_1[4:0] |

FIG. 9

OD

| REFERENCE GRAYSCALE | BAND1 | | | BAND2 | | |
|---|---|---|---|---|---|---|
| 255 | GOS_V255_R | GOS_V255_G | GOS_V255_B | GOS_V255_R | GOS_V255_G | GOS_V255_B |
| 203 | GOS_V203_R | GOS_V203_G | GOS_V203_B | GOS_V203_R | GOS_V203_G | GOS_V203_B |
| ... | | | | | | |
| 7 | GOS_V7_R | GOS_V7_G | GOS_V7_B | GOS_V7_R | GOS_V7_G | GOS_V7_B |
| 1 | GOS_V1_R | GOS_V1_G | GOS_V1_B | GOS_V1_R | GOS_V1_G | GOS_V1_B |

DISPLAY DEVICE AND RELATED OPERATING METHOD INVOLVING DIMMING CONTROL

CROSS-REFERENCE TO RELATED APPLICATION(S)

This application claims priority under 35 USC § 119 to Korean Patent Application No. 10-2018-0021731, filed on Feb. 23, 2018 in the Korean Intellectual Property Office (KIPO); the Korean Patent Application is incorporated herein in its entirety by reference.

BACKGROUND

1. Technical Field

The technical field relates generally to a display device. More particularly, the technical field relates to a display device that can perform a dimming operation and an operating method of the display device.

2. Description of the Related Art

Generally, a display device includes a display panel and a panel driver. The display panel includes a plurality of pixels. The panel driver includes a scan driver that provides scan output signals to the pixels and includes a data driver that provides data voltages to the pixels. The data driver converts image data in a digital form into data signals in an analog form based on grayscale gamma voltages, wherein the image data is input from a timing controller.

To adjust a dimming level, the display device may adjust a gamma curve. In other words, the display device may change luminance by adjusting the grayscale gamma voltages according to the dimming level. In addition, to reduce power consumption or to prevent a phenomenon that a light-emission is delayed in a low-grayscale region, the display device may adjust a power voltage applied to the pixels according to the dimming level. When the dimming level is adjusted, an undesirable luminance inversion (or luminance kink) phenomenon may occur because of a change in the power voltage.

SUMMARY

Some embodiments may be related to a display device that can perform a dimming control without an undesirable luminance inversion phenomenon.

Some embodiments may be related to an operating method of the display device.

According to embodiments, a display device may include a display panel including a plurality of pixels, a dimming controller configured to generate at least one temporary voltage set by performing a first interpolating operation using a (j)th band voltage set and a (j+1)th band voltage set among first through (i)th band voltage sets corresponding to first through (i)th dimming bands, respectively, where i is an integer greater than 1 and j is an integer greater than or equal to 1 and smaller than i, and to generate a grayscale gamma voltage set corresponding to target luminance by performing a second interpolating operation using the temporary voltage set and the (j)th band voltage set, and a panel driver configured to drive the display panel by converting image data into a data signal based on the grayscale gamma voltage set and by providing the data signal to the pixels.

In embodiments, the dimming controller may include a band data obtaining unit configured to obtain the (j)th band voltage set and the (j+1)th band voltage set based on the target luminance, a first interpolating unit configured to generate first through (k)th temporary voltage sets, where k is an integer greater than 1, by performing the first interpolating operation using the (j)th band voltage set and the (j+1)th band voltage set, a voltage set selecting unit configured to select one among the first through (k)th temporary voltage sets based on index data corresponding to a (j)th dimming band, a second interpolating unit configured to generate first through (p)th interpolated voltage sets, where p is an integer greater than 1, by performing the second interpolating operation using the (j)th band voltage set and the one which is selected among the first through (k)th temporary voltage sets, and a gamma voltage generating unit configured to generate the grayscale gamma voltage set corresponding to the target luminance based on the first through (p)th interpolated voltage sets.

In embodiments, the index data may include an index value according to a reference grayscale for each of first through (i−1)th dimming bands.

In embodiments, the first through (k)th temporary voltage sets corresponding to respective dimming levels between a first dimming level corresponding to the (j)th band voltage set and a second dimming level corresponding to the (j+1)th band voltage set may be generated by the first interpolating operation.

In embodiments, the first through (p)th interpolated voltage sets corresponding to respective dimming levels between a first dimming level corresponding to the (j)th band voltage set and a second dimming level corresponding to the (j+1)th band voltage set may be generated by the second interpolating operation.

In embodiments, a number of the first through (k)th temporary voltage sets may be equal to a number of the first through (p)th interpolated voltage sets.

In embodiments, the display device may further include a power supply configured to provide a power voltage to the pixels. Here, the band data obtaining unit may obtain a (j)th pixel voltage offset and a (j+1)th pixel voltage offset among first through (i)th pixel voltage offsets corresponding to the first through (i)th dimming bands, respectively based on the target luminance. In addition, the dimming controller may further include a pixel voltage determining unit configured to generate a signal for adjusting the power voltage based on the (j)th pixel voltage offset and the (j+1)th pixel voltage offset.

In embodiments, the pixel voltage determining unit may obtain a target offset by performing a third interpolating operation using the (j)th pixel voltage offset and the (j+1)th pixel voltage offset. In addition, the power supply may adjust the power voltage to have a voltage level which is obtained by adding the target offset to a reference power voltage.

In embodiments, the dimming controller may include a band data obtaining unit configured to obtain the (j)th band voltage set and the (j+1)th band voltage set based on the target luminance, a third interpolating unit configured to generate a representative temporary voltage set by performing the first interpolating operation using the (j)th band voltage set and the (j+1)th band voltage set, an offset setting unit configured to update the representative temporary voltage set based on a temporary voltage offset, a fourth interpolating unit configured to generate first through (p)th interpolated voltage sets, where p is an integer greater than 1, by performing the second interpolating operation using the (j)th band voltage set and the updated representative temporary voltage set, and a gamma voltage generating unit configured to generate the grayscale gamma voltage set corresponding to the target luminance based on the first through (p)th interpolated voltage sets.

In embodiments, the temporary voltage offset may include an offset value according to a reference grayscale for each of first through (i−1)th dimming bands.

In embodiments, the representative temporary voltage set corresponding to one which is closest to a second dimming level among respective dimming levels between a first dimming level corresponding to the (j)th band voltage set and the second dimming level corresponding to the (j+1)th band voltage set may be generated by the first interpolating operation.

In embodiments, the first through (p)th interpolated voltage sets corresponding to respective dimming levels between a first dimming level corresponding to the (j)th band voltage set and a second dimming level corresponding to the (j+1)th band voltage set may be generated by the second interpolating operation.

According to embodiments, an operating method of a display device may include obtaining a (j)th band voltage set and a (j+1)th band voltage set among first through (i)th band voltage sets corresponding to first through (i)th dimming bands, respectively based on target luminance, where i is an integer greater than 1 and j is an integer greater than or equal to 1 and smaller than i, generating at least one temporary voltage set by performing a first interpolating operation using the (j)th band voltage set and the (j+1)th band voltage set, generating a grayscale gamma voltage set corresponding to the target luminance by performing a second interpolating operation using the temporary voltage set and the (j)th band voltage set, converting image data into a data signal based on the grayscale gamma voltage set, and displaying an image corresponding to the data signal.

In embodiments, generating the temporary voltage set may include generating first through (k)th temporary voltage sets, where k is an integer greater than 1, by performing the first interpolating operation using the (j)th band voltage set and the (j+1)th band voltage set. In addition, generating the grayscale gamma voltage set may include selecting one among the first through (k)th temporary voltage sets based on index data corresponding to a (j)th dimming band, and generating first through (p)th interpolated voltage sets, where p is an integer greater than 1, by performing the second interpolating operation using the (j)th band voltage set and the one which is selected among the first through (k)th temporary voltage sets.

In embodiments, the index data may include an index value according to a reference grayscale for each of first through (i−1)th dimming bands.

In embodiments, the first through (k)th temporary voltage sets corresponding to respective dimming levels between a first dimming level corresponding to the (j)th band voltage set and a second dimming level corresponding to the (j+1)th band voltage set may be generated by the first interpolating operation.

In embodiments, the first through (p)th interpolated voltage sets corresponding to respective dimming levels between a first dimming level corresponding to the (j)th band voltage set and a second dimming level corresponding to the (j+1)th band voltage set may be generated by the second interpolating operation.

In embodiments, generating the temporary voltage set may include generating a representative temporary voltage set by performing the first interpolating operation using the (j)th band voltage set and the (j+1)th band voltage set. In addition, generating the grayscale gamma voltage set may include updating the representative temporary voltage set based on a temporary voltage offset, and generating first through (p)th interpolated voltage sets, where p is an integer greater than 1, by performing the second interpolating operation using the (j)th band voltage set and the updated representative temporary voltage set.

In embodiments, the temporary voltage offset may include an offset value according to a reference grayscale for each of first through (i−1)th dimming bands.

In embodiments, the representative temporary voltage set corresponding to one which is closest to a second dimming level among respective dimming levels between a first dimming level corresponding to the (j)th band voltage set and the second dimming level corresponding to the (j+1)th band voltage set may be generated by the first interpolating operation.

A display device according to embodiments may generate grayscale gamma voltages which do not result in a significant luminance inversion (or luminance kink) phenomenon and thus may change a dimming level without a significant luminance inversion phenomenon. In embodiments, the display device may have a desirable reaction speed for a grayscale-change because the display device is able to adjust a power voltage according to target luminance (or the dimming level).

In embodiments, an operating method of the display device may enable a smooth change of a dimming level.

BRIEF DESCRIPTION OF THE DRAWINGS

FIG. 3 is a diagram illustrating an example of dimming band data used when the dimming controller of FIG. 2 adjusts a dimming level.

FIG. 4 is a diagram illustrating an example of index data used when the dimming controller of FIG. 2 selects one of temporary voltage sets.

FIG. 9 is a diagram illustrating an example of temporary voltage offset data used when the dimming controller of FIG. 8 adjusts a representative temporary voltage set.

DETAILED DESCRIPTION

Example embodiments are explained with reference to the accompanying drawings. Although the terms "first," "second," etc. may be used herein to describe various elements, these elements, should not be limited by these terms. These terms may be used to distinguish one element from another element. Thus, a first element may be termed a second element without departing from teachings of one or more embodiments. The description of an element as a "first" element may not require or imply the presence of a second element or other elements. The terms "first," "second," etc. may also be used herein to differentiate different categories or sets of elements. For conciseness, the terms "first," "second," etc. may represent "first-type (or first-set)," "second-type (or second-set)," etc., respectively.

Figure 1:
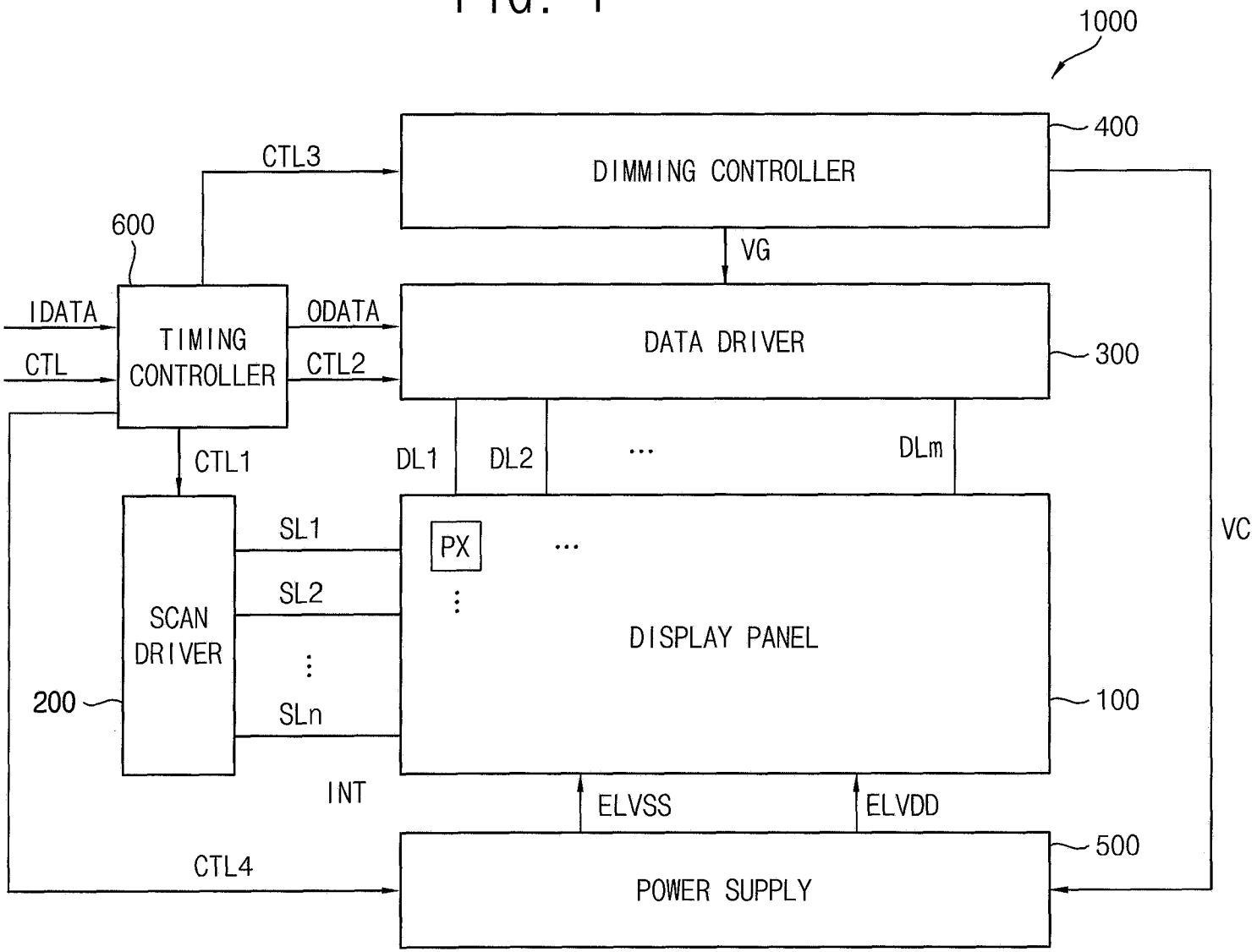
FIG. 1 is a block diagram illustrating a display device according to embodiments.

FIG. 1 is a block diagram illustrating a display device according to embodiments.

Referring to FIG. 1, the display device 1000 may include a display panel 100 that includes a plurality of pixels PX and a panel driver that drives the display panel 100. In an embodiment, the panel driver may include a scan driver 200, a data driver 300, a dimming controller 400, a power supply 500, and a timing controller 600. In an embodiment, the display device 1000 may be an organic light emitting display device.

The display panel 100 may include the pixels PX to display an image. For example, the display panel 100 may include n×m pixels arranged at locations corresponding to intersections between scan-lines SL1, SL2, through SLn and data-lines DL1, DL2, through DLm, where n and m are integers greater than 1.

The scan driver 200 may provide scan signals to the pixels PX via the scan-lines SL1 through SLn based on a first control signal CTL1.

The data driver 300 may convert digital image data ODATA into analog data voltages (i.e., data signals) based on a grayscale gamma voltage set VG and a second control signal CTL2 and may provide the data signals to the pixels PX via the data-lines DL1 through DLm.

The dimming controller 400 may output a plurality of grayscale gamma voltages corresponding to target (or desired) luminance as the grayscale gamma voltage set VG. The dimming controller 400 may generate at least one temporary voltage set by performing a first interpolating operation using a (j)th band voltage set and a (j+1)th band voltage set among first through (i)th band voltage sets corresponding to first through (i)th dimming bands, respectively, where i is an integer greater than 1 and where j is an integer greater than or equal to 1 and smaller than i, and may generate the grayscale gamma voltage set VG corresponding to the target luminance by performing a second interpolating operation using the temporary voltage set and the (j)th band voltage set. The dimming band indicates a reference position (i.e., reference dimming level) for performing the first and second interpolating operations. The band voltage set of the dimming band indicates reference voltages for generating the grayscale gamma voltage set VG corresponding to the target luminance. In an embodiment, the dimming controller 400 may generate a voltage control signal VC for adjusting a second power voltage ELVSS applied to the pixels PX based on the target luminance. Example structures of the dimming controller 400 are described with reference to FIGS. 2 and 8.

The power supply 500 may provide a first power voltage ELVDD and the second power voltage ELVSS to the pixels PX based on a fourth control signal CTL4. The first power voltage ELVDD may be applied to a driving transistor included in a/each pixel PX. The second power voltage ELVSS may be applied to a cathode of an organic light emitting diode included in the pixel PX. In an embodiment, the power supply 500 may adjust at least one voltage level of the first power voltage ELVDD and the second power voltage ELVSS based on the voltage control signal VC. To reduce power consumption or to prevent a phenomenon that a light-emission is delayed in a low-grayscale region by a parasitic component (e.g., parasitic capacitance) of the organic light emitting diode, the power supply 500 may adjust at least one voltage level of the first power voltage ELVDD and the second power voltage ELVSS based on the target luminance. For example, the power supply 500 may include a DC-DC converter that generates, using an input voltage (e.g., battery voltage), the second power voltage ELVSS to have a voltage level which is obtained by adding a target (or desired) offset included in the voltage control signal VC to a reference power voltage.

The timing controller 600 may control the scan driver 200, the data driver 300, the dimming controller 400, and the power supply 500. For example, the timing controller 600 may receive a control signal CTL from an external component (e.g., system board). The timing controller 600 may generate the first through fourth control signals CTL1 through CTL4 to control the scan driver 200, the data driver 300, the dimming controller 400, and the power supply 500, respectively. The first control signal CTL1 for controlling the scan driver 200 may include a vertical start signal, a clock signal, etc. The second control signal CTL2 for controlling the data driver 300 may include a horizontal start signal, a load signal, image data, etc. The third control signal CTL3 for controlling the dimming controller 400 may include the target luminance (or, dimming level), etc. The fourth control signal CTL4 for controlling the power supply 500 may include a control signal for controlling a voltage level, etc. The timing controller 600 may generate the digital image data ODATA suitable for an operating condition of the display panel 100 based on input image data IDATA and may provide the digital image data ODATA to the data driver 300.

The display device 1000 may generate the grayscale gamma voltages which do not result in a significant luminance inversion (or luminance kink) phenomenon and thus may change the dimming level without an undesirable luminance inversion phenomenon.

Figure 2:
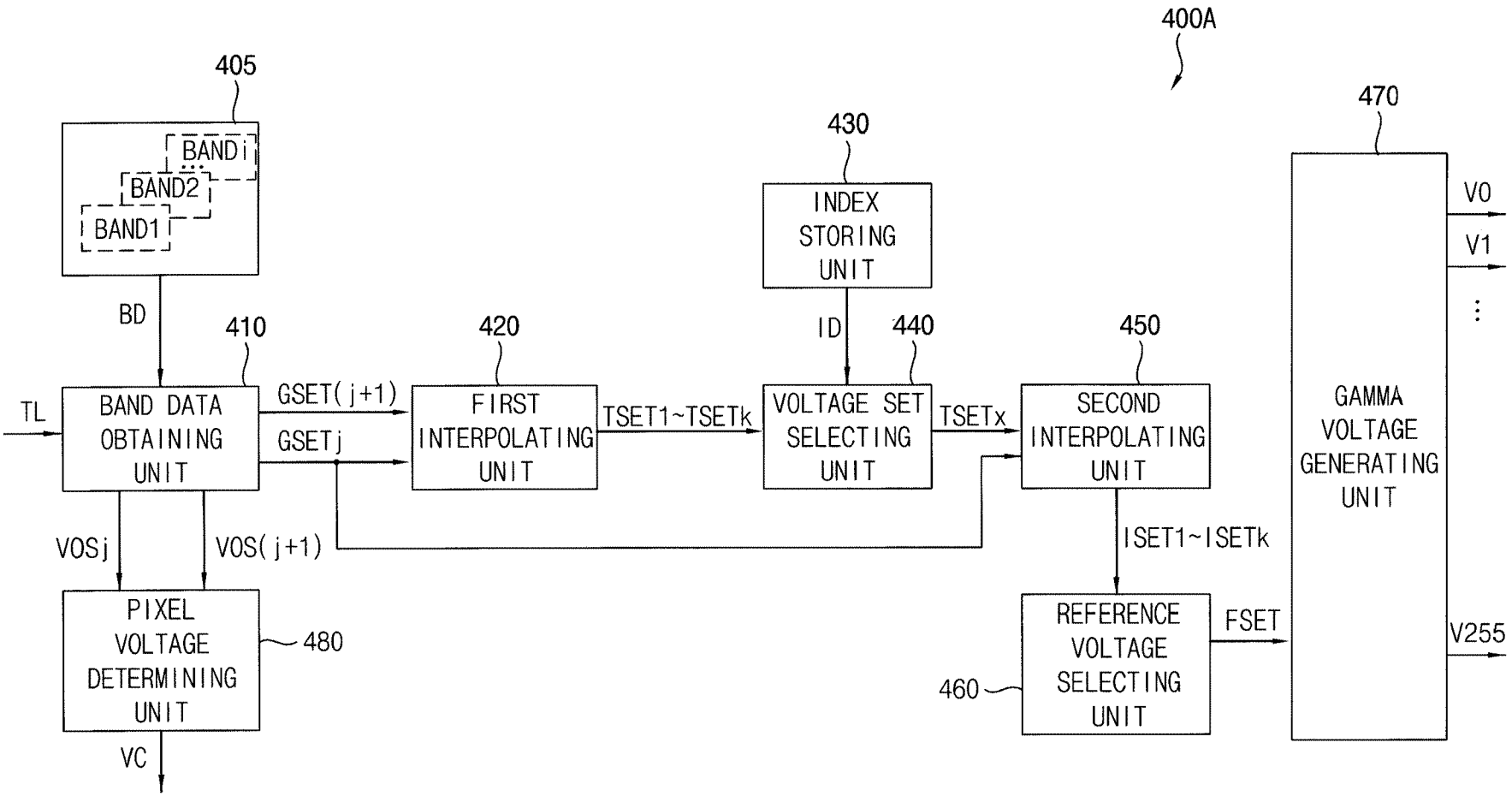
FIG. 2 is a block diagram illustrating an example/embodiment of a dimming controller included in the display device of FIG. 1.

FIG. 2 is a block diagram illustrating an example/embodiment of a dimming controller included in the display device of FIG. 1, FIG. 3 is a diagram illustrating an example of dimming band data used when the dimming controller of FIG. 2 adjusts a dimming level, and FIG. 4 is a diagram illustrating an example of index data used when the dimming controller of FIG. 2 selects one of temporary voltage sets.

Referring to FIGS. 2 to 4, the dimming controller 400A may include a band data storing unit 405, a band data obtaining unit 410, a first interpolating unit 420, an index storing unit 430, a voltage set selecting unit 440, a second interpolating unit 450, a reference voltage selecting unit 460, a gamma voltage generating unit 470, and a pixel voltage determining unit 480.

The band data storing unit 405 may store dimming band data BD corresponding to first through (i)th dimming bands, respectively. In an embodiment, as illustrated in FIG. 3, the dimming band data BD may include the target luminance, the dimming level, the band voltage set, the pixel voltage offset for each of the first through (i)th dimming bands. The target luminance indicates luminance which is required when the display device displays an image corresponding to a maximum grayscale (e.g., 255). The dimming level corresponds to the target luminance and indicates a luminance adjustable level which a user is able to adjust. For example, when the target luminance includes a range between 2 nit and 750 nit and has a dimming address of 11 bit, the target luminance of the display device may be adjusted using about 2000 dimming levels in the range between 2 nit and 750 nit. The band voltage set indicates a voltage set for generating the grayscale gamma voltage set corresponding to the target luminance. For example, the band voltage set may include a plurality of gamma reference voltages. The pixel voltage offset indicates an offset for adjusting a power voltage applied to the pixels (e.g., the second power voltage ELVSS of FIG. 1).

The band data obtaining unit 410 may obtain a (j)th band voltage set GSETj and a (j+1)th band voltage set GSET(j+1) among first through (i)th band voltage sets GSET1 through GSETi from the dimming band data BD based on the target luminance TL, where the first through (i)th band voltage sets GSET1 through GSETi correspond to first through (i)th dimming bands BAND1 through BANDi, respectively. The band data obtaining unit 410 may obtain the (j)th band voltage set GSETj and the (j+1)th band voltage set GSET (j+1) from the dimming band data of two dimming bands (i.e., the (j)th and (j+1)th dimming bands) with target luminance values that are close (or closest) to the target luminance TL. For example, when the target luminance TL is 3 nit, the band data obtaining unit 410 may obtain the first band voltage set GSET1 of the first dimming band BAND1 and the second band voltage set GSET2 of the second dimming band BAND2.

In an embodiment, the band data obtaining unit 410 may obtain a (j)th pixel voltage offset VOSj and a (j+1)th pixel voltage offset VOS(j+1) among first through (i)th pixel voltage offsets from the dimming band data BD based on the target luminance TL, where the first through (i)th pixel voltage offsets correspond to the first through (i)th dimming bands BAND1 through BANDi, respectively. For example, when the target luminance TL is 3 nit, the band data obtaining unit 410 may obtain the first pixel voltage offset (e.g., 0.5 V) of the first dimming band BAND1 and the second pixel voltage offset (e.g., 0.6 V) of the second dimming band BAND2.

The first interpolating unit 420 may generate first through (k)th temporary voltage sets, where k is an integer greater than 1, by performing the first interpolating operation using the (j)th band voltage set GSETj and the (j+1)th band voltage set GSET(j+1). The first interpolating unit 420 may perform an interpolation between the (j)th band voltage set GSETj and the (j+1)th band voltage set GSET(j+1) according to the dimming levels. In an embodiment, the first through (k)th temporary voltage sets TSET1 through TSETk corresponding to respective dimming levels between a first dimming level and a second dimming level. The first dimming level may correspond to the (j)th band voltage set GSETj, and the second dimming level may correspond to the (j+1)th band voltage set GSET(j+1). For example, the first through (50)th temporary voltage sets may correspond to 50 dimming levels between the dimming level of 139 and the dimming level of 190. The dimming level of 139 may correspond to the first band voltage set GSET1, and the dimming level of 190 may correspond to the second band voltage set GSET2. The first through (50)th temporary voltage sets may be generated by the first interpolating operation.

The index storing unit 430 may store index data ID corresponding to each of the first through (i)th dimming bands. In an embodiment, referring to FIG. 4, the index data ID may include an index value according to a reference grayscale for each of the first through (i−1)th dimming bands. The reference grayscale indicates a grayscale of a gamma reference voltage for generating the grayscale gamma voltage set. For example, the index data ID may include an index value corresponding to 10 reference grayscales (e.g., 1, 7, 11, 23, 35, 51, 87, 151, 203, and 255 labeled V1, V7, . . . V203, and V255) for each dimming band. The index value may indicate a position for the temporary voltage sets. The index value of the index data ID may be generated by measuring a voltage range which does not result in the luminance kink phenomenon.

The voltage set selecting unit 440 may select one TSETx among the first through (k)th temporary voltage sets based on the index data ID corresponding to the (j)th dimming band. For example, when the index value corresponding to the (j)th dimming band is 30, the voltage set selecting unit 440 may select the (30)th temporary voltage set.

The second interpolating unit 450 may generate first through (k−1)th interpolated voltage sets ISET1 through ISET(k−1) by performing the second interpolating operation using the (j)th band voltage set GSETj and the one TSETx which is selected among the first through (k)th temporary voltage sets to be a second band voltage set ISETk. In an embodiment, the first through (k−1)th interpolated voltage sets ISET1 through ISET(k−1) may correspond to respective dimming levels between a first dimming level corresponding to the second band voltage set ISETk.

The reference voltage selecting unit 460 may select one corresponding to the target luminance TL among the first through (k)th interpolated voltage sets ISET1 through ISETk as a gamma reference voltage set FSET.

The gamma voltage generating unit 470 may generate grayscale gamma voltages V0, V1, through V255 (i.e., the grayscale gamma voltage set) corresponding to the target luminance TL based on the gamma reference voltage set FSET. For example, the gamma voltage generating unit 470 may include at least one resistor string for generating the grayscale gamma voltages V0 through V255 based on the gamma reference voltage set FSET.

The pixel voltage determining unit 480 may generate a voltage control signal VC for adjusting the power voltage based on the (j)th pixel voltage offset VOSj and the (j+1)th pixel voltage offset VOS(j+1). In an embodiment, the pixel voltage determining unit 480 may obtain a target offset by performing a third interpolating operation using the (j)th pixel voltage offset VOSj and the (j+1)th pixel voltage offset VOS(j+1). For example, when the target luminance TL is 3 nit, the pixel voltage determining unit 480 may obtain the target offset between the first pixel voltage offset (e.g., 0.5 V) of the first dimming band BAND1 and the second pixel voltage offset (e.g., 0.6 V) of the second dimming band BAND2 and may provide the target offset as the voltage control signal VC to the power supply.

Although it is described above that the number of the temporary voltage sets generated by the first interpolating unit 420 is equal to the number of the interpolated voltage sets generated by the second interpolating unit 450, the number of the temporary voltage sets generated by the first interpolating unit 420 may be different from the number of the interpolated voltage sets generated by the second interpolating unit 450.

Although it is described above that the luminance increases as the dimming level increases, in embodiments, the luminance may decrease as the dimming level increases.

Figure 5:
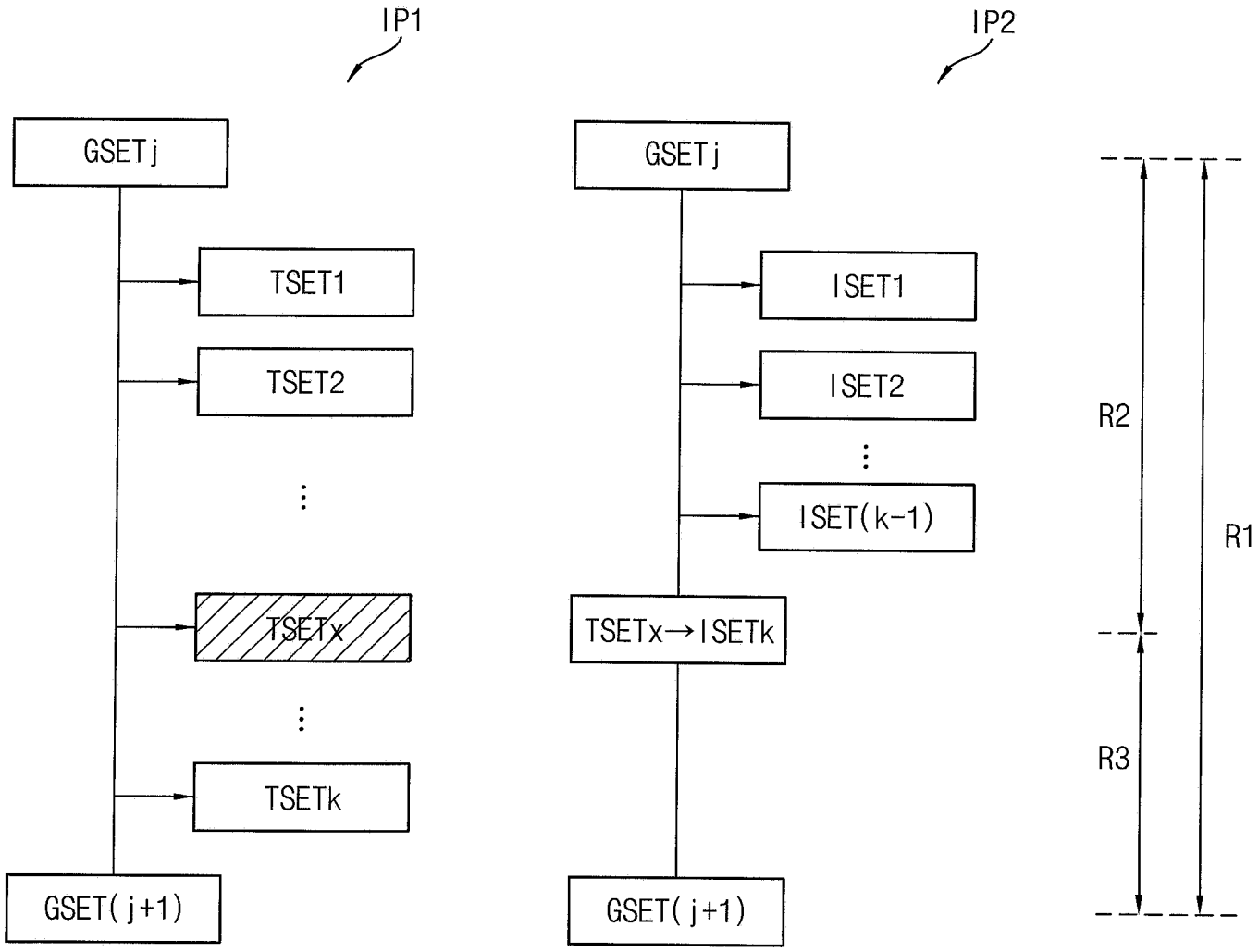
FIG. 5 is a diagram illustrating an example in which the dimming controller of FIG. 2 performs a first interpolating operation and a second interpolating operation.

FIG. 5 is a diagram illustrating an example in which the dimming controller of FIG. 2 performs a first interpolating operation and a second interpolating operation.

Referring to FIG. 5, the dimming controller may generate a grayscale gamma voltage set (which does not result in an undesirable luminance kink phenomenon) by performing a first interpolating operation IP1 and a second interpolating operation IP2. The first interpolating operation IP1 and the second interpolating operation IP2 may be performed on respective reference voltages included in band voltage sets or a temporary voltage set.

The first interpolating operation IP1 may be performed between the (j)th band voltage set GSETj and the (j+1)th band voltage set GSET(j+1). For example, when k dimming levels exist between a first dimming level corresponding to the (j)th band voltage set GSETj and a second dimming level corresponding to the (j+1)th band voltage set GSET(j+1), the first through (k)th temporary voltage sets TSET1 through TSETk may be generated by the first interpolating operation IP1. A linear interpolation may be performed on a first range R1 between each reference voltage of the (j)th band voltage set GSETj and each reference voltage of the (j+1)th band voltage set GSET(j+1) by the first interpolating operation IP1. When a reference voltage in a third region R3 which is generated by the first interpolating operation IP1 is set as the gamma reference voltage, a luminance kink phenomenon may occur as the dimming level increases. Thus, performing the second interpolating operation IP2 may be required.

To prevent a luminance kink phenomenon, an interpolation may be performed on a second region R2 by the second interpolating operation IP2. Thus, a voltage set corresponding to the dimming level may be reset by the second interpolating operation IP2. An interpolation may be performed between the (j)th band voltage set GSETj and one TSETx which is selected among the first through (k)th temporary voltage sets by the second interpolating operation IP2. For example, by the second interpolating operation IP2, the selected temporary voltage set TSETx may be set as the (k)th interpolated voltage set ISETk, and the first through (k−1)th interpolated voltage sets ISET1 through ISET(k−1) may be generated between the (j)th band voltage set GSETj and the selected temporary voltage set TSETx.

One of the interpolated voltage sets ISET1 through ISET (k−1) of a second region R2 may be determined as the grayscale gamma voltage set by the first interpolating operation IP1 and the second interpolating operation IP2. Thus, an undesirable luminance kink phenomenon may be prevented.

Figure 6A:
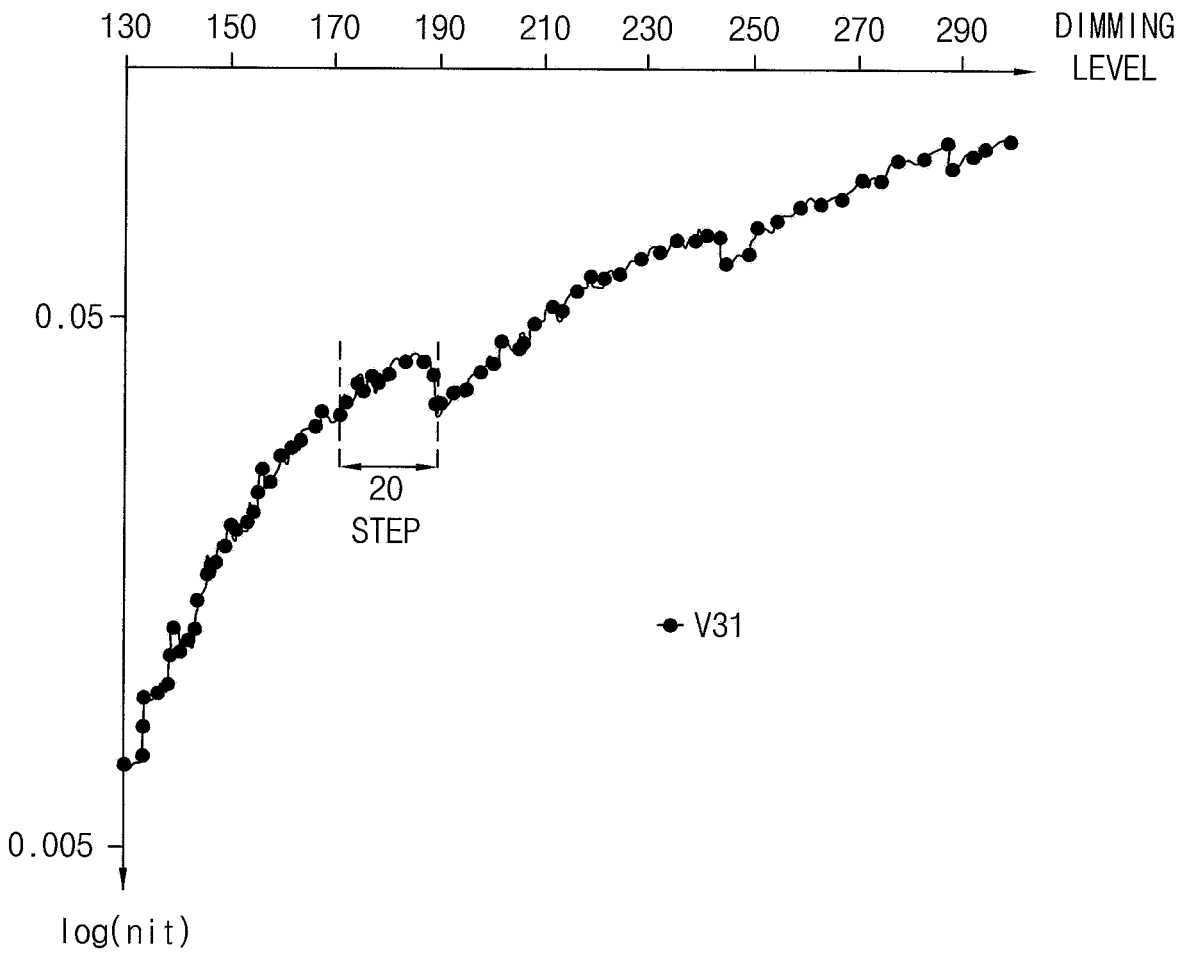
FIG. 6A, FIG. 6B, and FIG. 7 are diagrams for describing an effect of the display device of FIG. 1.
Figure 6B:
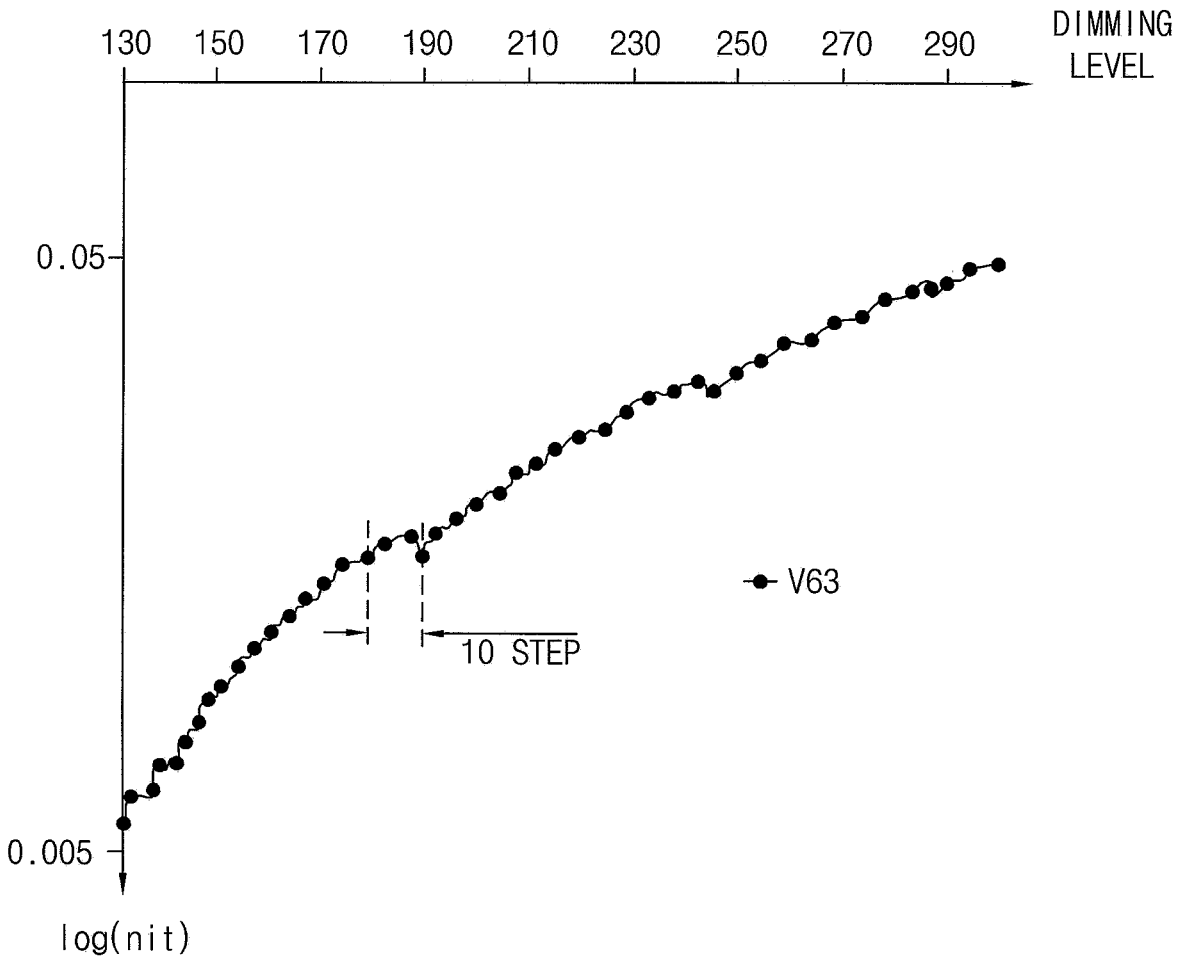
Figure 7:
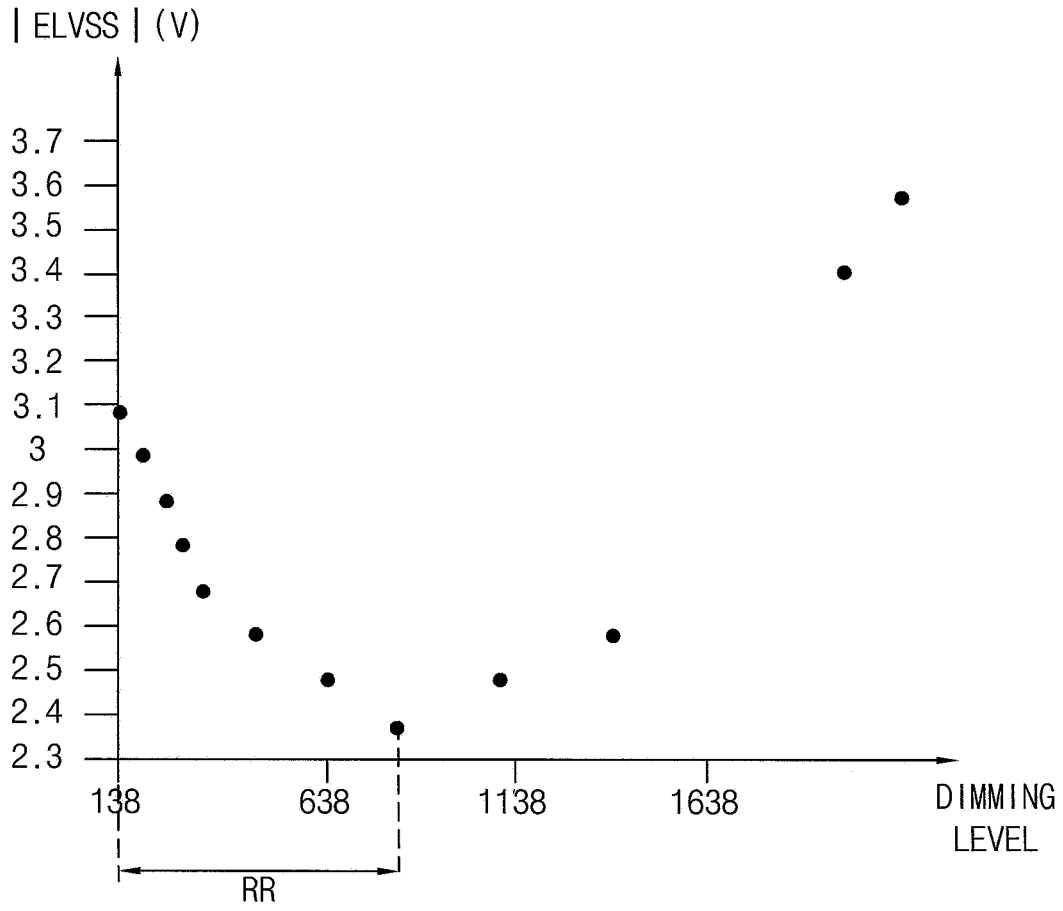

FIGS. 6A, 6B, and 7 are diagrams for describing an effect of the display device of FIG. 1.

Referring to FIGS. 6A, 6B, and 7, in a comparison display device that generates the grayscale gamma voltage set by performing only one interpolating operation using the dimming band data, the luminance kink phenomenon that the luminance is inverted (or dropped significantly) at a luminance level where the dimming band is changed may occur as the dimming level increases. For example, as illustrated in FIGS. 6A and 6B, when the pixel voltage offset corresponding to the first dimming band is 0.5 V and when the pixel voltage offset corresponding to the second dimming band is 0.6 V, the luminance kink phenomenon may occur as the dimming level increases because the second power voltage ELVSS is changed by 0.1 V at the dimming level of 190 where the dimming band is changed from the first dimming band to the second dimming band. In FIG. 6A, a greater luminance kink phenomenon may occur when the display device implements (or, displays) the grayscale of 31 as compared to FIG. 6B. That is, as the dimming level increases in the low-grayscale region, the greater luminance kink phenomenon may be observed in FIG. 6A as compared to FIG. 6B.

Thus, when the display device implements the grayscale voltage of V31 as illustrated in FIG. 6A, the display device may shift by about 20 dimming steps at a boundary between the first dimming band and the second dimming band and then may perform the second interpolating operation to prevent the luminance kink phenomenon. In addition, when the display device implements the grayscale voltage of V63 as illustrated in FIG. 6B, the display device may shift by about 10 dimming steps at a boundary between the first dimming band and the second dimming band and then may perform the second interpolating operation to prevent a significant luminance kink phenomenon.

As illustrated in FIG. 7, the second power voltage ELVSS may be adjusted according to the luminance in order to prevent a light-emission delay time from increasing according to a change in the grayscale in the low-grayscale region (e.g., the grayscale is changed from the grayscale of 0 to the grayscale of 255). For example, in the low-grayscale region, an absolute value of the second power voltage ELVSS may decrease (i.e., the offset may increase) as the luminance increases.

In an embodiment, because a luminance kink phenomenon may occur mainly in the low-grayscale (or, low-luminance) region RR as the luminance increases, the gamma reference voltage set may be generated by performing the first and second interpolating operations in the low-grayscale region RR, and the gamma reference voltage set may be generated by performing only the first interpolating operation in regions other than the low-grayscale region RR. In this case, load and memory capacity of the display device may be reduced.

Figure 8:
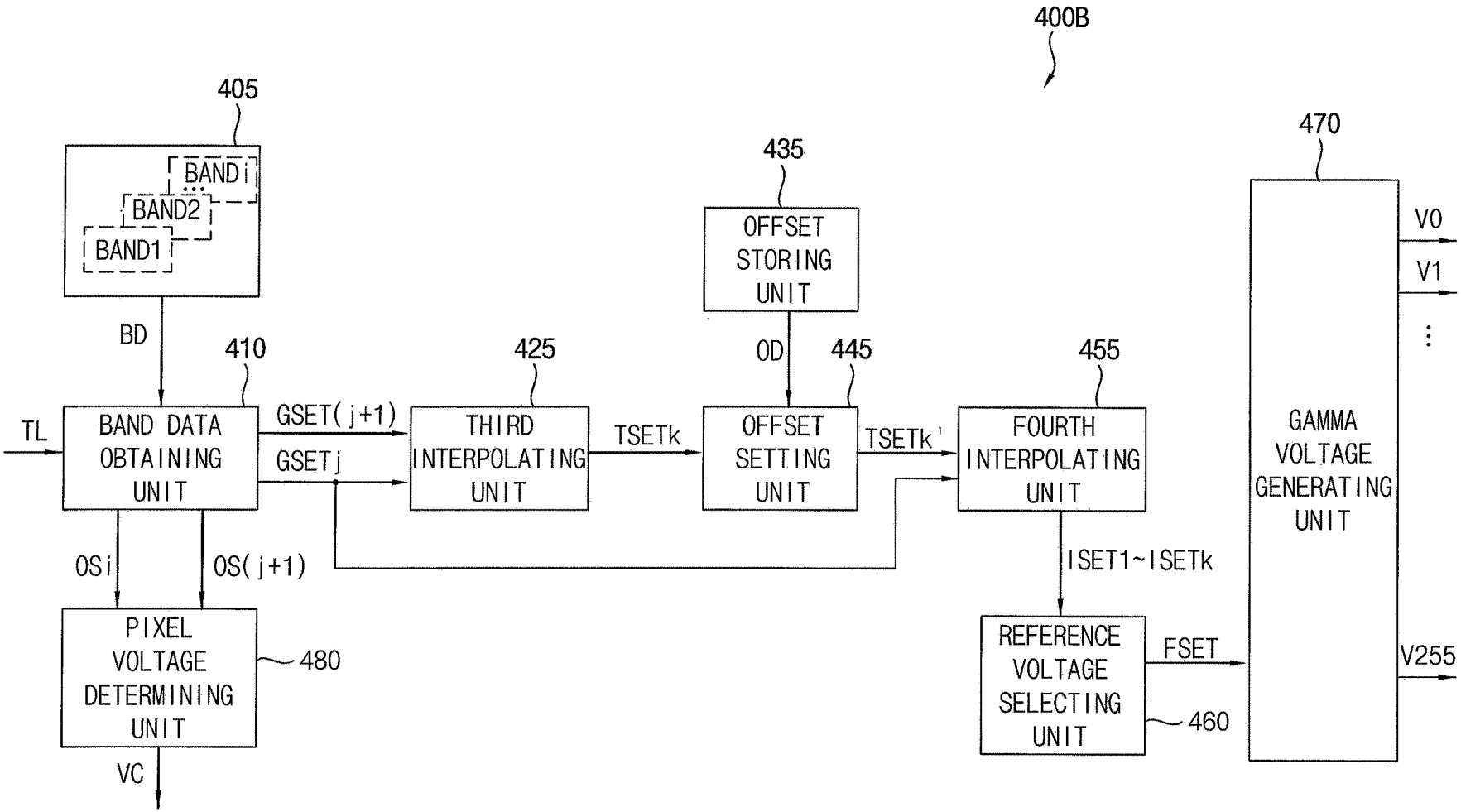
FIG. 8 is a block diagram illustrating an example/embodiment of a dimming controller included in the display device of FIG. 1.

FIG. 8 is a block diagram illustrating an example/embodiment of a dimming controller included in the display device of FIG. 1, and FIG. 9 is a diagram illustrating an example of temporary voltage offset data used when the dimming controller of FIG. 8 adjusts a representative temporary voltage set.

Referring to FIGS. 8 and 9, the dimming controller 400B may include a band data storing unit 405, a band data obtaining unit 410, a third interpolating unit 425, an offset storing unit 435, an offset setting unit 445, a fourth interpolating unit 455, a reference voltage selecting unit 460, a gamma voltage generating unit 470, and a pixel voltage determining unit 480. Except first and second interpolating operations, the dimming controller 400B may be substantially the same as or analogous to the dimming controller 400A of FIG. 2. Thus, the same reference numerals will be used for the same or similar components, and duplicated description may not be repeated.

The band data storing unit 405 may store dimming band data BD corresponding to first through (i)th dimming bands, respectively.

The band data obtaining unit 410 may obtain a (j)th band voltage set GSETj and a (j+1)th band voltage set GSET(j+1) among first through (i)th band voltage sets GSET1 through GSETi from the dimming band data BD based on the target luminance TL, where the first through (i)th band voltage sets GSET1 through GSETi correspond to first through (i)th dimming bands BAND1 through BANDi, respectively.

The third interpolating unit 425 may generate a representative temporary voltage set TSETk by performing a first interpolating operation using the (j)th band voltage set GSETj and the (j+1)th band voltage set GSET(j+1). The third interpolating unit 425 may output one corresponding to a predetermined index among temporary voltage sets which are obtained by the first interpolating operation as the representative temporary voltage set TSETk. In an embodiment, the representative temporary voltage set TSETk corresponds to a dimming level that is between a first dimming level and a second dimming level and is closest to the second dimming level. The first dimming level corresponds to the (j)th band voltage set GSETj, and the second dimming level corresponds to the (j+1)th band voltage set GSET(j+1). The representative temporary voltage set TSETk may be generated by the first interpolating operation. For example, the third interpolating unit 425 may determine the (k)th temporary voltage set as the representative temporary voltage set TSETk among the first through (k)th temporary voltage sets which are generated by performing an interpolation between the (j)th band voltage set GSETj and the (j+1)th band voltage set GSET(j+1).

The offset storing unit 435 may store a temporary voltage offset OD corresponding to each of the first through (i)th dimming bands. In an embodiment, referring to FIG. 9, the temporary voltage offset OD may include an offset value according to a reference grayscale for each of the first through (i−1)th dimming bands. The offset value may be generated by measuring a voltage range which does not result in a significant luminance kink phenomenon. In embodiments, different offsets may be set according to color light which the pixels emit.

The offset setting unit 445 may update the representative temporary voltage set TSETk based on the temporary voltage offset OD. For example, the updated representative temporary voltage set TSETk' may be generated by adding the offset value corresponding to each voltage of the representative temporary voltage set TSETk to the representative temporary voltage set TSETk.

The fourth interpolating unit 455 may generate first through (k)th interpolated voltage sets ISET1 through ISETk by performing a second interpolating operation using the (j)th band voltage set GSETj and the updated representative temporary voltage set TSETk'. In an embodiment, the first through (k)th interpolated voltage sets ISET1 through ISETk corresponding to respective dimming levels between a first dimming level corresponding to the (j)th band voltage set GSETj and a second dimming level corresponding to the (j+1)th band voltage set GSET(j+1) may be generated by the second interpolating operation.

The reference voltage selecting unit 460 may select one corresponding to the target luminance TL among the first through (k)th interpolated voltage sets ISET1 through ISETk as a gamma reference voltage set FSET.

The gamma voltage generating unit 470 may generate grayscale gamma voltages V0 through V255 (i.e., the grayscale gamma voltage set) corresponding to the target luminance TL based on the gamma reference voltage set FSET.

The pixel voltage determining unit 480 may generate a voltage control signal VC for adjusting the power voltage based on the (j)th pixel voltage offset VOSj and the (j+1)th pixel voltage offset VOS(j+1).

Figure 10:
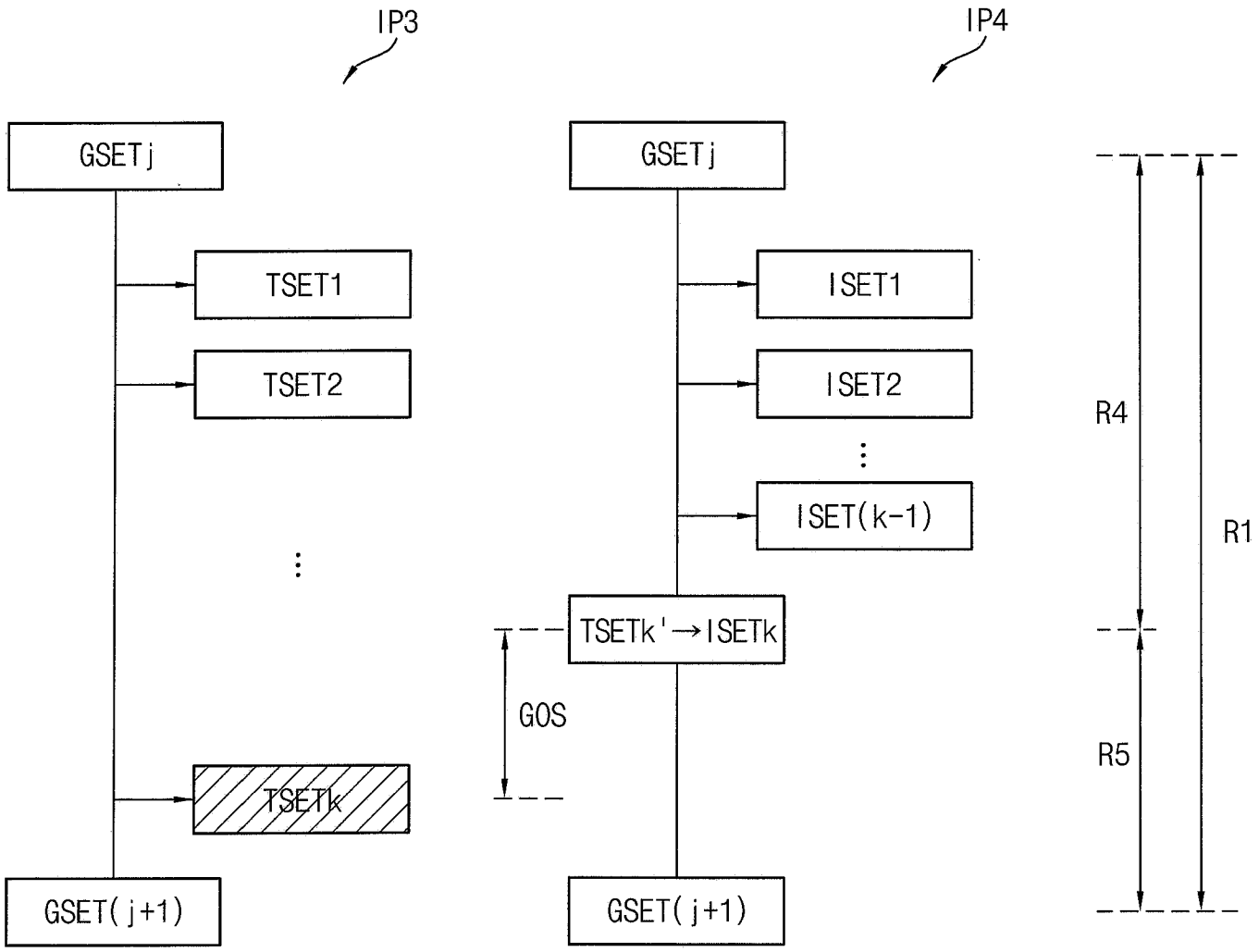
FIG. 10 is a diagram illustrating an example in which the dimming controller of FIG. 8 performs a first interpolating operation and a second interpolating operation.

FIG. 10 is a diagram illustrating an example in which the dimming controller of FIG. 8 performs a first interpolating operation and a second interpolating operation.

Referring to FIG. 10, the first interpolating operation IP3 may be performed between the (j)th band voltage set GSETj and the (j+1)th band voltage set GSET(j+1). For example, when k dimming levels exist between a first dimming level corresponding to the (j)th band voltage set GSETj and a second dimming level corresponding to the (j+1)th band voltage set GSET(j+1), the first through (k)th temporary voltage sets TSET1 through TSETk may be generated by the first interpolating operation IP3. The (k)th temporary voltage set TSETk may be selected as the representative temporary voltage set. When a voltage set in a fifth region R5 is set as the gamma reference voltage, a significant luminance kink phenomenon may occur as the dimming level increases. Thus, to prevent the luminance kink phenomenon, the updated representative temporary voltage set TSETk' may be generated by applying an offset value GOS of the temporary voltage offset to the (k)th temporary voltage set TSETk which is selected as the representative temporary voltage set.

An interpolation may be performed on a fourth region R4 by the second interpolating operation IP4. Thus, a voltage set corresponding to the dimming level may be reset by the second interpolating operation IP4. An interpolation may be performed between the (j)th band voltage set GSETj and the updated representative temporary voltage set TSETk' by the second interpolating operation IP4. For example, by the second interpolating operation IP4, the updated representative temporary voltage set TSETk' may be set as the (k)th interpolated voltage set ISETk, and the first through (k−1)th interpolated voltage sets ISET1 through ISET(k−1) may be generated between the (j)th band voltage set GSETj and the updated representative temporary voltage set TSETk'.

One of the interpolated voltage sets ISET1 through ISET(k−1) of a fourth region R4 may be determined as the grayscale gamma voltage set by the first interpolating operation IP3 and the second interpolating operation IP4. Thus, a significant luminance kink phenomenon may be prevented.

Figure 11:
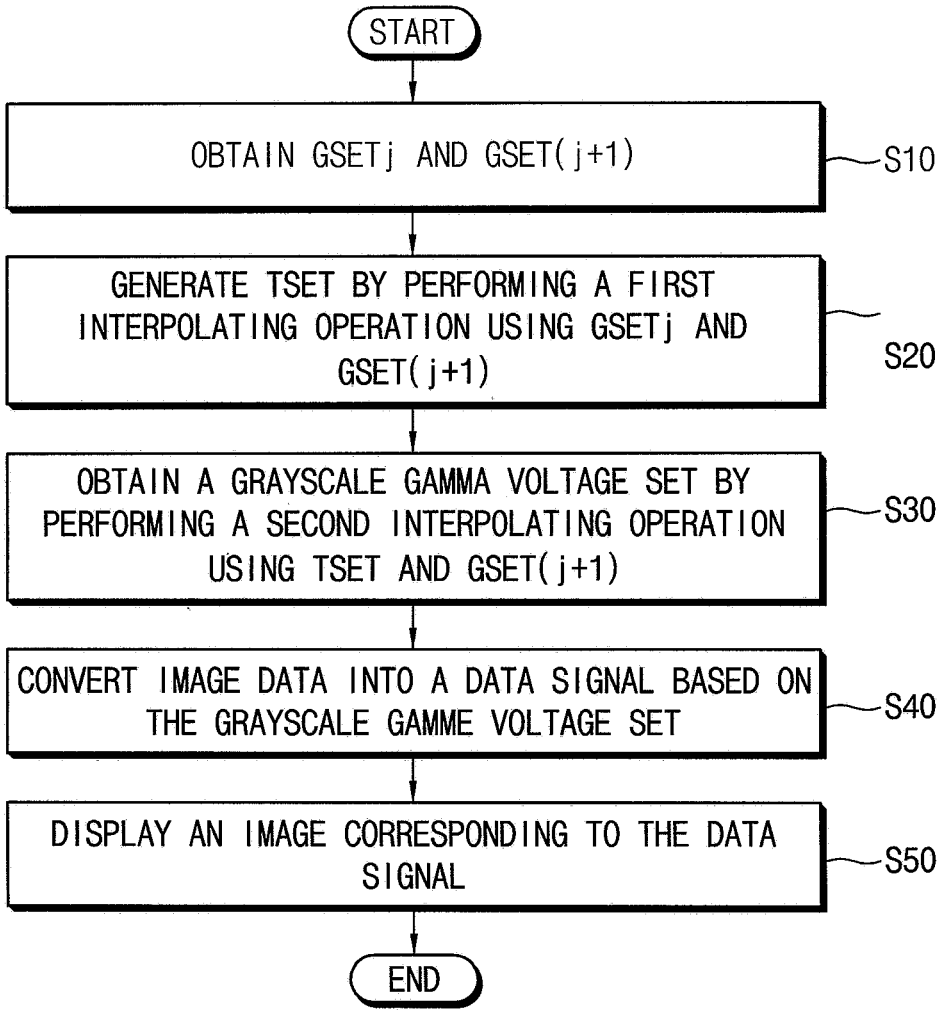
FIG. 11 is a flowchart illustrating an operating method of a display device according to embodiments.

FIG. 11 is a flowchart illustrating an operating method of a display device according to embodiments.

Referring to FIG. 11, the method of FIG. 11 may include obtaining a (j)th band voltage set GSETj and a (j+1)th band voltage set GSET(j+1) among first through (i)th band voltage sets corresponding to first through (i)th dimming bands, respectively, based on target luminance (S10).

The method of FIG. 11 may include generating at least one temporary voltage set TSET by performing a first interpolating operation using the (j)th band voltage set GSETj and the (j+1)th band voltage set GSET(j+1) (S20). The method of FIG. 11 may include generating a grayscale gamma voltage set corresponding to the target luminance by performing a second interpolating operation using the temporary voltage set TSET and the (j)th band voltage set GSETj (S30).

In an embodiment, the first through (k)th temporary voltage sets may be generated by performing the first interpolating operation between the (j)th band voltage set GSETj and the (j+1)th band voltage set GSET(j+1). One of the first through (k)th temporary voltage sets may be selected based on index data corresponding to a (j)th dimming band. The first through (p)th interpolated voltage sets, where p is an integer greater than 1, may be generated by performing the second interpolating operation between the (j)th band voltage set GSETj and the selected one of the first through (k)th temporary voltage sets. One of the first through (p)th interpolated voltage sets may be determined as the grayscale gamma voltage set based on the target luminance. Example embodiments of performing the first interpolating operation and the second interpolating operation based on the index data are described above.

In an embodiment, the representative temporary voltage set may be generated by performing the first interpolating operation between the (j)th band voltage set GSETj and the (j+1)th band voltage set GSET(j+1). The representative temporary voltage set may be updated based on the temporary voltage offset. The first through (p)th interpolated voltage sets may be generated by performing the second interpolating operation between the (j)th band voltage set GSETj and the updated representative temporary voltage set. One of the first through (p)th interpolated voltage sets may be determined as the grayscale gamma voltage set based on the target luminance. Example embodiments of performing the first interpolating operation and the second interpolating operation based on the temporary voltage offset are described above.

The method of FIG. 11 may convert image data into a data signal based on the grayscale gamma voltage set (S40) and may display an image corresponding to the data signal (S50).

Embodiments may be applied to an electronic device including a display device. For example, embodiments may be applied to a computer, a laptop, a cellular phone, a smart phone, a smart pad, a portable multimedia player (PMP), a personal digital assistant (PDA), an MP3 player, a digital camera, a video camcorder, etc.

The foregoing is illustrative of embodiments and is not to be construed as limiting. Although example embodiments have been described, those skilled in the art will readily appreciate that many modifications are possible in the example embodiments. All such modifications are intended to be included within the scope defined in the claims.

What is claimed is:

1. A display device, comprising:

a display panel including a plurality of pixels;

a dimming controller configured to generate a temporary voltage set by performing a first interpolating operation using a (j)th band voltage set and a (j+1)th band voltage set among first through (i)th band voltage sets corresponding to first through (i)th dimming bands, respectively, and configured to generate a grayscale gamma voltage set corresponding to target luminance by performing a second interpolating operation using the temporary voltage set and the (j)th band voltage set, wherein the i is an integer greater than 1, wherein the j is an integer greater than or equal to 1 and smaller than the i, wherein the second interpolating operation results in first through (p)th interpolated voltage sets, wherein the p is an integer, and wherein the grayscale gamma voltage set is one of the first through (p)th interpolated voltage sets or the temporary voltage set; and a panel driver configured to drive the display panel by converting image data into a data signal based on the grayscale gamma voltage set and by providing the data signal to the pixels.

2. The display device of claim 1, wherein the dimming controller comprises:

a band data obtaining unit configured to obtain the (j)th band voltage set and the (j+1)th band voltage set based on the target luminance;

a first interpolating unit configured to generate first through (k)th temporary voltage sets by performing the first interpolating operation using the (j)th band voltage set and the (j+1)th band voltage set, wherein the k is an integer greater than 1;

a voltage set selecting unit configured to select the temporary voltage set among the first through (k)th temporary voltage sets based on an index value corresponding to a voltage range which does not cause a luminance kink phenomenon for a (j)th dimming band;

a second interpolating unit configured to generate the first through (p)th interpolated voltage sets by performing the second interpolating operation using the (j)th band voltage set and the temporary voltage set, wherein the p is an integer greater than 1; and a gamma voltage generating unit configured to generate the grayscale gamma voltage set corresponding to the target luminance based on the first through (p)th interpolated voltage sets.

3. The display device of claim 2, wherein the dimming controller further comprises: an index storing unit storing index values according to a reference grayscale for first through (i−1)th dimming bands, respectively.

4. The display device of claim 2, wherein the first through (k)th temporary voltage sets correspond to respective dimming levels between a first dimming level and a second dimming level, wherein the first dimming level corresponds to the (j)th band voltage set, and wherein the second dimming level corresponds to the (j+1)th band voltage set.

5. The display device of claim 2, wherein the first through (p)th interpolated voltage sets correspond to respective dimming levels between a first dimming level and a second dimming level, wherein the first dimming level corresponds to the (j)th band voltage set, and wherein the second dimming level corresponds to the (j+1)th band voltage set.

6. The display device of claim 2, wherein a total number of voltage sets of the first through (k)th temporary voltage sets is equal to a total number of voltage sets of the first through (p)th interpolated voltage sets.

7. The display device of claim 2, further comprising:

a power supply configured to provide a power voltage to the pixels, wherein the band data obtaining unit obtains a (j)th pixel voltage offset and a (j+1)th pixel voltage offset among first through (i)th pixel voltage offsets corresponding to the first through (i)th dimming bands, respectively, based on the target luminance, and wherein the dimming controller further comprises:

a pixel voltage determining unit configured to generate a signal for adjusting the power voltage based on the (j)th pixel voltage offset and the (j+1)th pixel voltage offset.

8. The display device of claim 7, wherein the pixel voltage determining unit is configured to obtain a target offset by performing a third interpolating operation using the (j)th pixel voltage offset and the (j+1)th pixel voltage offset, and wherein the power supply is configured to determine a voltage level of the power voltage by adding the target offset to a reference power voltage.

9. The display device of claim 1, wherein the dimming controller comprises:

a band data obtaining unit configured to obtain the (j)th band voltage set and the (j+1)th band voltage set based on the target luminance;

a third interpolating unit configured to generate a representative temporary voltage set by performing the first interpolating operation using the (j)th band voltage set and the (j+1)th band voltage set;

an offset setting unit configured to update the representative temporary voltage set based on a temporary voltage offset to generate an updated representative temporary voltage set;

a fourth interpolating unit configured to generate first through (p)th interpolated voltage sets by performing the second interpolating operation using the (j)th band voltage set and the updated representative temporary voltage set, wherein the p is an integer greater than 1; and a gamma voltage generating unit configured to generate the grayscale gamma voltage set corresponding to the target luminance based on the first through (p)th interpolated voltage sets.

10. The display device of claim 9, wherein the temporary voltage offset includes an offset value according to a reference grayscale for each of first through (i−1)th dimming bands.

11. The display device of claim 9, wherein the representative temporary voltage set corresponds to a dimming level that is between a first dimming level and a second dimming level and is closest to the second dimming level, wherein the first dimming level corresponds to the (j)th band voltage set, and wherein the second dimming level corresponds to the (j+1)th band voltage set.

12. The display device of claim 9, wherein the first through (p)th interpolated voltage sets correspond to respective dimming levels between a first dimming level and a second dimming level, wherein the first dimming level corresponds to the (j)th band voltage set, and wherein the second dimming level corresponds to the (j+1)th band voltage set.

13. An operating method of a display device, the method comprising:

obtaining a (j)th band voltage set and a (j+1)th band voltage set among first through (i)th band voltage sets corresponding to first through (i)th dimming bands, respectively, based on target luminance, wherein the i is an integer greater than 1, and wherein the j is an integer greater than or equal to 1 and smaller than i;

generating a temporary voltage set by performing a first interpolating operation using the (j)th band voltage set and the (j+1)th band voltage set;

generating a grayscale gamma voltage set corresponding to the target luminance by performing a second interpolating operation using the temporary voltage set and the (j)th band voltage set, wherein the second interpolating operation results in first through (p)th interpolated voltage sets, wherein the p is an integer, and wherein the grayscale gamma voltage set is one of the first through (p)th interpolated voltage sets or the temporary voltage set;

converting image data into a data signal based on the grayscale gamma voltage set; and displaying an image corresponding to the data signal.

14. The method of claim 13, wherein generating the temporary voltage set comprises:

generating first through (k)th temporary voltage sets by performing the first interpolating operation using the (j)th band voltage set and the (j+1)th band voltage set, wherein the k is an integer greater than 1, and wherein generating the grayscale gamma voltage set comprises:

selecting the temporary voltage set among the first through (k)th temporary voltage sets based on an index value corresponding to a voltage range which does not cause a luminance kink phenomenon for a (j)th dimming band; and selecting the grayscale gamma voltage set from the first through (p)th interpolated voltage sets and the temporary voltage set, where the p is greater than 1.

15. The method of claim 14, further comprising: storing index values according to a reference grayscale for first through (i−1)th dimming bands, respectively.

16. The method of claim 14, wherein the first through (k)th temporary voltage sets correspond to respective dimming levels between a first dimming level and a second dimming level, wherein the first dimming level corresponds to the (j)th band voltage set, and wherein the second dimming level corresponds to the (j+1)th band voltage set.

17. The method of claim 14, wherein the first through (p)th interpolated voltage sets correspond to respective dimming levels between a first dimming level and a second dimming level, wherein the first dimming level corresponds to the (j)th band voltage set, and wherein the second dimming level corresponds to the (j+1)th band voltage set.

18. The method of claim 13, wherein generating the temporary voltage set comprises:

generating a representative temporary voltage set by performing the first interpolating operation using the (j)th band voltage set and the (j+1)th band voltage set, and wherein generating the grayscale gamma voltage set comprises:

updating the representative temporary voltage set based on a temporary voltage offset to generate an updated representative temporary voltage set; and generating first through (p)th interpolated voltage sets by performing the second interpolating operation using the (j)th band voltage set and the updated representative temporary voltage set, wherein the p is an integer greater than 1.

19. The method of claim 18, wherein the temporary voltage offset includes an offset value according to a reference grayscale for each of first through (i−1)th dimming bands.

20. The method of claim 18, wherein the representative temporary voltage set corresponds to a dimming level that is between a first dimming level and a second dimming level and is closest to the second dimming level, wherein the first dimming level corresponds to the (j)th band voltage set, and wherein the second dimming level corresponds to the (j+1)th band voltage set.

* * * * *